United States Patent [19]

Andersen

[11] Patent Number: 4,495,993

[45] Date of Patent: Jan. 29, 1985

[54] METHOD FOR IN-SITU RECOVERY OF ENERGY RAW MATERIALS BY THE INTRODUCTION OF CRYOGENIC LIQUID CONTAINING OXYGEN

[76] Inventor: Leonard M. Andersen, 46 Alexander Ave., Yonkers, N.Y. 10704

[21] Appl. No.: 325,925

[22] Filed: Nov. 30, 1981

[51] Int. Cl.[3] ..... E21B 43/243

[52] U.S. Cl. ..... 166/261; 166/272; 166/302

[58] Field of Search ..... 166/256, 257, 261, 263, 166/271, 272, 302, 308, 274

[56] References Cited

U.S. PATENT DOCUMENTS

| | | | |
|---|---|---|---|
| 3,032,103 | 5/1962 | Parker | 166/256 |
| 3,064,728 | 11/1962 | Gould | 166/263 X |
| 3,332,482 | 7/1967 | Trantham | 166/263 X |
| 3,399,722 | 9/1968 | Buxton et al. | 166/263 X |
| 3,581,821 | 6/1971 | Ross | 166/271 X |
| 3,759,329 | 9/1973 | Ross | 166/302 X |
| 3,822,747 | 7/1974 | Maguire, Jr. | 166/308 X |
| 4,042,026 | 8/1977 | Pusch et al. | 166/258 |

*Primary Examiner*—George A. Suchfield

*Attorney, Agent, or Firm*—Darby & Darby

[57] ABSTRACT

A method for recovering energy raw materials from a subterranean formation whereby a gas or liquid is injected into the borehole and adjacent formation and vented as required to prevent undesirable combustion or reaction with the introduction of a cryogenic liquid containing oxygen. This cryogenic liquid, when introduced, yields unexpected benefits by its tendency to flow downward and horizontally along the bottom barrier of the pay zone, forming pockets, reacting with material in the formation, fracturing the formation, simultaneously in close proximity heating by combustion and cooling by vaporization, and yielding a unique displacement (flood) due to combustion, reaction and volitallization products formed.

There are two preferred embodiments, first introducing the cryogenic liquid containing oxygen into a borehole and after a period of time producing from the same borehole. Second, introducing the liquid into a pattern of injection borehole(s) and forming a mobile from which can be pushed by another injected liquid or gas and producing from another borehole or other boreholes.

9 Claims, No Drawings

METHOD FOR IN-SITU RECOVERY OF ENERGY RAW MATERIALS BY THE INTRODUCTION OF CRYOGENIC LIQUID CONTAINING OXYGEN

BACKGROUND OF THE INVENTION

This invention relates to a method for recovering energy raw materials from a subterranean formation by the introduction of cryogenic liquids containing oxygen into the formation.

Recovery of energy raw materials from subterranean formations is done by several methods such as fracturing the formation, in-situ combustion, and thermal displacement. The invention of the in-situ combustion method for petroleum recovery by F. A. Howard in 1923, did not yield substantial recoveries until recently due to control problems and the unpredictability of the method. This in-situ combustion method produces sufficient heat within a petroleum reservoir which, by means of partial combustion of the oil residues in the petroleum reservoir, enable the recovery of the remaining oil. The important processes contributing to petroleum displacement are (1) viscosity reduction by means of heat, distillation and cracking, (2) sweeping out of the oil with hot water, and (3) extraction of the oil by means of miscible products. This is similar to the method specified in U.S. Pat. No. 3,026,935. There are benefits to the use of higher partial pressures of oxygen in injected combustion sustaining fluid in that a miscible carbon dioxide product would be formed and the mix would have greater reactivity. The amount of combustion heat released for example in a reaction between oxygen and organic fuels is on average 3,000 kcal. per Kg oxygen.

Oxygen has draw backs as a gas when used with energy raw materials and steel. Its reactivity in higher purities can cause fires and explosions. The handling of compressed oxygen flowing through piping systems requires special precautions which have been developed. Such precautions include the use of large inner surfaces in relation to volume, appropriate geometry to prevent local temperature peaks, and lower purity oxygen content, i.e. at less than 95% steel can be ignited but combustion is not self-sustaining. This leads to a need for obtaining the benefits of high partial pressure of oxygen in in-situ combustion without the foregoing drawbacks.

The reactivity of and associated danger of oxygen in a cryogenic liquid state is far less and its use is increasing. There are requirements due to the cryogenic temperatures. This is well understood and has been reduced to practice for decades, and amounts to the use of nickel alloys, aluminum, and certain design features, Within a petroleum formation, the channelling and vaporization expansion of the cryogenic fluid fractures the formation. The gaseous product of this volatilization causes a miscible and/or non-miscible displacement of the oil driving it from an injection borehole to a production borehole in a flood pattern arrangement. The characteristics of cryogenic liquid nitrogen are known in a variety of formations as are the combustion characteristics of oxygen containing gases. The physical properties of a cryogenic liquid containing oxygen would be similar to cryogenic liquid oxygen. The combined effect would be predictable to an extent based on information on specific formation experience with cryogenic liquid nitrogen and oxygen containing gas relative to introduction into said formation of a cryogenic liquid containing oxygen.

According to U.S. Pat. No. 4,042,026, the most dangerous point along the oxygen flow path is the borehole. This danger could be lessened or eliminated by several means. The very nature of a cryogenic liquid containing oxygen lessens said danger. Also, a cryogenic liquid with lesser concentration of oxygen or no oxygen may be injected as a pretreatment. There are many gases and liquids which may be injected into the borehole and which, through reaction or displacement, lessen said danger. Another means would be through the limited injection of an oxygen containing gas, causing a limited in-situ burn in the borehole and adjacent energy raw material containing formation.

It is therefore the objective of this invention to recover energy raw materials namely, petroleum hydrocarbons, including shale oil, heavy oil, natural gas, and oil from depleted wells or unobtainable by other means more efficiently in appropriate substerranean formations, preferably using conventional equipment used in boreholes for the recovery of energy raw materials such as petroleum hydrocarbons.

DESCRIPTION OF THE PREFERRED EMBODIMENTS

There are two basic modes of operation. First, where all introduction of gas and liquid is through one borehole, and all production of energy raw materials is from the same borehole after a period of time. The second is where all introduction of gas and liquid is through one or more boreholes (establishing a mobile front or flood) driving the desired energy raw material to borehole(s) different from the borehole(s) where gas and liquid were introduced. The pretreatment required to lessen the possibility of premature and/or undesired combustion in the borehole and the subterranean energy raw materials bearing formation close to the borehole would be determined to a greater extent by the nature of the borehole and formation than by the embodiment chosen.

One way this may be done is to inject an oxygen containing gas into the formation, and allow time to achieve a limited volume in-situ combustion and permit the borehole and the formation adjacent to it to cool. The combustion products are vented and the process repeated until the desired clearing of combustibles is achieved. Another means to achieve this would be to introduce a cryogenic liquid and/or inert gas and/or liquid such as water into the borehole and appropriate subterranean formation adjacent to said borehole to prevent the undesired consequences noted upon subsequent introduction of a cryogenic liquid containing oxygen. In petroleum wells and applications with similar configurations, a tube of stainless steel (or other material with suitable cryogenic temperature capability) would be used within said borehole with packings above and below (if necessary) the pay zone, to inject (introduce) a cryogenic liquid and/or inert gas and/or liquid such as water.

The cryogenic liquid containing oxygen in one embodiment is introduced into the borehole which is to be the borehole from which production is to be taken after the "huff and puff" in-situ burn treatment. The introduction of the cryogenic liquid containing oxygen is done through the tubular packing arrangement noted or other suitable means. The cryogenic liquid containing oxygen can have the percentage of oxygen varied during its introduction to achieve maximum benefit. The low fluidity of the cryogenic liquid containing oxygen allows greater control of the in-situ burn than that attainable with an oxygen containing gas. Cryogenic liquid containing oxygen allows more efficient use of oxygen due to the tendency of the cryogenic liquid containing oxygen to flow downward and to form higher partial pressure of gaseous oxygen upon volatilization within the subterranean formation. After the initial introduction of the cryogenic liquid containing oxygen, an injection of a liquid or a gas can be used to prevent the in-situ combustion and/or chemical reaction from damaging the borehole and/or its contents, or to move the cryogenic liquid containing oxygen for subsequent introduction of liquids or gas. This can be repeated yielding concentric patterns around the borehole of the cryogenic liquid containing oxygen, and other liquid and gas mobilizers. After the introduction(s) of the cryogenic liquid containing oxygen is complete, and the subsequent injection of a liquid and gas (or other means) to preserve the integrity of the borehole and its contents, a period of time is allowed to pass without flow through the borehole.

Within the subterranean formation the unexpected benefaction of the cryogenic liquid containing oxygen occurs. As the temperature rises the cryogenic liquid containing oxygen which has flowed downwardly and/or horizontally forms pockets and vaporizes. The resulting oxygen containing gas, and the cooling effect of the cryogenic fluid, forms pockets which upon reaching the required temperature to pressure ratio for the oxygen and energy raw material in the borehole results in combustion. The combustion would be in slow flame and detonation forms. The detonation would be of limited volume as occur in an internal combustion engine. There would be fracturing due to the vaporization thermal effect and shock associated with this.

The chemical products of this combustion reaction-cracking process would be different from that achievable with an oxygen containing gas in that the localized pressure and temperature would, to an extent, be determined by the cryogenic volatilization and detonation achieved. These chemical products, including carbon dioxide, water and unreactive volatilized portions of the cryogenic liquid containing oxygen, would, due to the heat of the in-situ combustion and lower density, tend to rise and move horizontally within the raw energy material bearing subterranean formation. This displacing flood would thermally and through miscibility displace and/or mobilize liquid and/or gaseous hydrocarbons. The different chemical products and flow pattern would tend to make this flood more efficient. The phenomena noted would unexpectedly occur simultaneously in close proximity due to the pocketing nature noted.

The time required for this to occur would be in the order of days and be determined by the exact formation and recovery program. Sufficient time should be allowed to provide for fracturing, thermal, shock and displacement mechanisms to reach optimum levels. Approximately 10 to 20 days would be reasonable with experience and/or downhole monitoring determining the exact time. The production phase would be similar to a normal huff and puff in-situ combustion techniques.

The second major embodiment would be to introduce gas, liquid, cryogenic liquid containing oxygen into one or more borehole(s) and remove the desired energy raw material from other borehole(s). The surprising mechanisms noted would be similar to the one borehole embodiment with one direction frontal flow toward the borehole from which the desired energy raw material is to be removed. The production would be similar to other in-situ combustion systems. The difference would be more applications, greater control, less loss of the oxygen, and greater recovery than with the use of in-situ combustion with an oxygen containing gas.

The gas injected to mobilize the oil would normally be air, or "inert gas" generated by combustion of hydrocarbons, or natural gas. The mobilizing liquid would normally be water. The cryogenic liquid pretreatment would be liquid nitrogen or liquid carbon dioxide. The composition of the cryogenic liquid containing oxygen would be from 20 to 100% oxygen by weight with the remainder a material that will mix with liquid oxygen, i.e. nitrogen or carbon dioxide. In case of a flow interrupt an appropriate backup system would be provided.

I claim:

1. A method for recovering energy raw materials such as oil and gas from a subterranean formation penetrated by a borehole, comprising the steps of:

introducing into said borehole a fluid material which will prevent combustion of a cryogenic liquid containing oxygen to be subsequently introduced;

thereafter continuously introducing a cryogenic liquid containing oxygen into said borehole through a suitable pipe so that said cryogenic liquid contacts the adjacent subterranean formation; and closing the borehole and permitting the oxygen to vaporize, the amount of oxygen and its pressure being sufficient to enable a limited combustion of the available energy raw materials in the borehole.

2. A process according to claim 1, wherein said material comprises an oxygen-containing gas, the amount of oxygen being sufficient so that an in-situ combustion of limited scale will occur within an area of said borehole to rid said area of combustibles.

3. A process according to claim 1, wherein said fluid material comprises an inert gas.

4. A process according to claim 3 wherein said inert gas is selected from the class including nitrogen and carbon dioxide.

5. A process according to claim 3 wherein said fluid material further includes a liquid.

6. A process according to claim 1 wherein energy raw materials are removed from the borehole into which the cryogenic liquid containing oxgen is introduced.

7. A process according to claim 1 wherein energy raw materials are removed from a borehole other than the borehole into which said cryogenic liquid containing oxygen is introduced.

8. A process according to claim 1 wherein the oxygen concentration of the cryogenic liquid containing oxygen is between 20 and 100% by weight.

9. A process according to claim 1, wherein the oxygen content of the cryogenic liquid containing oxygen is varied during the introduction thereof.

* * * * *